US007753746B1

(12) United States Patent
Pesant

(10) Patent No.: US 7,753,746 B1
(45) Date of Patent: Jul. 13, 2010

(54) DUAL STEERING NOZZLE MARINE JET PROPULSION SYSTEM

(75) Inventor: Gilles Pesant, Palm Bay, FL (US)

(73) Assignee: Bombardier Recreational Products Inc., Valcourt (CA)

( * ) Notice: Subject to any disclaimer, the term of this patent is extended or adjusted under 35 U.S.C. 154(b) by 156 days.

(21) Appl. No.: 12/059,751

(22) Filed: Mar. 31, 2008

(51) Int. Cl.
*B63H 11/113* (2006.01)
*B63H 11/107* (2006.01)
*B63H 11/117* (2006.01)

(52) U.S. Cl. ..... 440/42; 440/40; 440/43

(58) Field of Classification Search ..... 440/38, 440/40, 42, 43, 47; 114/55.5, 55.52
See application file for complete search history.

(56) References Cited

U.S. PATENT DOCUMENTS 5,370,562 A * 12/1994 Nanami ..... 440/42
5,593,329 A 1/1997 Kato
5,803,775 A 9/1998 Henmi

* cited by examiner

*Primary Examiner*—Daniel V Venne
(74) *Attorney, Agent, or Firm*—Osler, Hoskin & Harcourt LLP

(57) ABSTRACT

A marine jet propulsion system has a jet pump, a venturi connected to the jet pump, a first steering nozzle rotationally mounted relative to the venturi about a first steering axis, and a second steering nozzle rotationally mounted relative to the first steering nozzle about a second steering axis. The second steering axis is disposed rearwardly of the first steering axis. Rotation of the first steering nozzle relative to the venturi about the first steering axis in a steering direction causes the second steering axis to rotate about the first steering axis in the steering direction and the second steering nozzle to rotate relative to the first steering nozzle about the second steering axis in the steering direction. A watercraft having the jet propulsion system and a nozzle assembly for a marine jet propulsion system are also disclosed.

16 Claims, 16 Drawing Sheets

DUAL STEERING NOZZLE MARINE JET PROPULSION SYSTEM

FIELD OF THE INVENTION

The present invention relates to a dual steering nozzle marine jet propulsion system and to watercraft having such a system.

BACKGROUND OF THE INVENTION

There exist many different ways to propel watercraft. One way is to use what is known as a jet propulsion system which is powered by an engine of the watercraft. The jet propulsion system typically consists of a jet pump which pressurizes water from the body of water and expels it through a venturi as a jet rearwardly of the watercraft to create thrust. Usually, a steering nozzle is pivotally mounted rearwardly of the venturi. The steering nozzle is operatively connected to a steering assembly of the watercraft which causes it to turn left or right to redirect the jet of water and thereby steer the watercraft.

As would be understood, the more the steering nozzle can be rotated relative to the venturi, the more maneuverable the watercraft can be. However, beyond a certain angle of rotation of the steering nozzle relative to the venturi, the change in direction of the water from the venturi to the steering nozzle becomes too abrupt, leading to losses in propulsive efficiency. This loss in efficiency is due the increased turbulence and friction created as the nozzle is increasingly rotated. This can eventually lead to choking of the water flow in the jet pump upstream of the venturi, which in turn leads to a reduction in engine speed (because of the impeller in the choked flow) and therefore thrust loss. For these reasons, the maximum angle of rotation of the steering nozzle relative to the venturi has been limited to angles of about 20 to 25 degrees.

Therefore, there is a need for a jet pump assembly which permits water exiting the venturi to be redirected by greater angles.

SUMMARY OF THE INVENTION

It is an object of the present invention to ameliorate at least some of the inconveniences present in the prior art.

It is also an object of the present invention to provide a steering nozzle assembly for a marine jet propulsion system including two steering nozzles, with one of the steering nozzles rotationally connected to the other of the steering nozzles.

It is another object of the present invention to provide a marine jet propulsion system having the above-described steering nozzle assembly.

It is yet another object of the present invention to provide a watercraft having the above-described marine jet propulsion system.

In one aspect, the invention provides a watercraft having a hull, a deck disposed on the hull, an engine supported by the hull, and a jet pump connected to the hull. The jet pump is operatively connected to the engine. A venturi is connected to the jet pump. A first steering nozzle is rotationally mounted relative to the venturi about a first steering axis. The first steering axis extends in a first generally vertical plane containing a central longitudinal axis of the first steering nozzle. A second steering nozzle is rotationally mounted relative to the first steering nozzle about a second steering axis. The second steering axis extends in a second generally vertical plane containing a central longitudinal axis of the second steering nozzle. The second steering axis is disposed rearwardly of the first steering axis. A steering assembly is disposed at least in part on the deck and is operatively connected to the first steering nozzle for rotating the first steering nozzle relative to the venturi about the first steering axis. Rotation of the first steering nozzle relative to the venturi about the first steering axis in a steering direction causes the second steering axis to rotate about the first steering axis in the steering direction and the second steering nozzle to rotate relative to the first steering nozzle about the second steering axis in the steering direction.

In a further aspect, a bracket is mounted to one of the jet pump, the venturi, and the hull. The first steering nozzle is rotationally mounted to one of the bracket and the venturi about the first steering axis.

In an additional aspect, the bracket is a trim support rotationally mounted relative to the venturi about a trim axis. The trim axis extends generally laterally and horizontally. The first steering nozzle is rotationally mounted to the trim support. The first and second steering axes are rotatable about the trim axis with the trim support.

In a further aspect, a first linkage has a first end and a second end. The first end is rotationally connected to the bracket and the second end is rotationally connected to the second steering nozzle. When the first and second generally vertical planes are generally co-planar, the first end is disposed on a first side of the generally vertical planes and the second end is disposed on a second side of the generally vertical planes. The second side is opposite the first side.

In an additional aspect, a second linkage is disposed below the first steering nozzle. The second linkage has a first end and a second end. The first end of the second linkage is operatively rotationally connected to one of the bracket and the venturi, and the second end is rotationally connected to the second steering nozzle. When the first and second generally vertical planes are generally co-planar, the first end of the second linkage is disposed on the first side of the generally vertical planes and the second end of the second linkage is disposed on the second side of the generally vertical planes. The first linkage is disposed above the first steering nozzle.

In a further aspect, when the first and second generally vertical planes are generally co-planar, the first end is disposed rearwardly of the first steering axis and forwardly of the second steering axis.

In an additional aspect, a steering arm is connected to a side of the first steering nozzle. The steering assembly is operatively connected to the steering arm such that pulling on the steering arm towards a front of the watercraft causes the first steering nozzle to rotate about the first steering axis in one steering direction. The second steering nozzle has an indentation on one side thereof. When the second steering nozzle is rotated relative to the first steering nozzle about the second steering axis in the one steering direction, part of the steering arm is received in the indentation.

In a further aspect, one of the first and second steering nozzles has a first boss formed about the second steering axis between upper portions of the first and second steering nozzles such that the first steering nozzle contacts the second steering nozzle via the first boss. One of the first and second steering nozzles has a second boss formed about the second steering axis between lower portions of the first and second steering nozzles such that the first steering nozzle contacts the second steering nozzle via the second boss.

In another aspect, the invention provides a marine jet propulsion system having a jet pump, a venturi connected to the jet pump, a first steering nozzle rotationally mounted relative to the venturi about a first steering axis, and a second steering nozzle rotationally mounted relative to the first steering nozzle about a second steering axis. The first steering axis extends in a first generally vertical plane containing a central longitudinal axis of the first steering nozzle. The second steering axis extends in a second generally vertical plane containing a central longitudinal axis of the second steering nozzle. The second steering axis is disposed rearwardly of the first steering axis. Rotation of the first steering nozzle relative to the venturi about the first steering axis in a steering direction causes the second steering axis to rotate about the first steering axis in the steering direction and the second steering nozzle to rotate relative to the first steering nozzle about the second steering axis in the steering direction.

In an additional aspect, a bracket is mounted to one of the jet pump and the venturi. The first steering nozzle is rotationally mounted to one of the bracket and the venturi about the first steering axis.

In a further aspect, the bracket is a trim support rotationally mounted relative to the venturi about a trim axis. The trim axis extends generally laterally and horizontally. The first steering nozzle is rotationally mounted to the trim support. The first and second steering axes are rotatable about the trim axis with the trim support.

In an additional aspect, a first linkage has a first end and a second end. The first end is rotationally connected to the bracket and the second end is rotationally connected to the second steering nozzle. When the first and second generally vertical planes are generally co-planar, the first end is disposed on a first side of the generally vertical plane and the second end is disposed on a second side of the generally vertical plane. The second side is opposite the first side.

In a further aspect, a second linkage is disposed below the first steering nozzle. The second linkage has a first end and a second end. The first end of the second linkage is operatively rotationally connected to one of the bracket and the venturi, and the second end is rotationally connected to the second steering nozzle. When the first and second generally vertical planes are generally co-planar, the first end of the second linkage is disposed on the first side of the generally vertical planes and the second end of the second linkage is disposed on the second side of the generally vertical planes. The first linkage is disposed above the first steering nozzle.

In an additional aspect, when the first and second generally vertical planes are generally co-planar, the first linkage axis is disposed rearwardly of the first steering axis and forwardly of the second steering axis.

In a further aspect, a steering arm is connected to a side of the first steering nozzle. The second steering nozzle has an indentation on one side thereof. When the second steering nozzle is rotated relative to the first steering nozzle about the second steering axis in one steering direction, part of the steering arm is received in the indentation.

In an additional aspect, one of the first and second steering nozzles has a first boss formed about the second steering axis between upper portions of the first and second steering nozzles such that the first steering nozzle contacts the second steering nozzle via the first boss. One of the first and second steering nozzles has a second boss formed about the second steering axis between lower portions of the first and second steering nozzles such that the first steering nozzle contacts the second steering nozzle via the second boss.

In yet another aspect, the invention provides a steering nozzle assembly for a marine jet propulsion system having a first steering nozzle having a first aperture in a first side thereof and a second aperture in a second side thereof opposite the first side, and a second steering nozzle rotationally mounted relative to the first steering nozzle about a second steering axis. The first and second apertures are coaxial with a first steering axis. The first steering axis is generally perpendicular to a central longitudinal axis of the first steering nozzle. The second steering axis is offset from the first steering axis and is generally perpendicular to a central longitudinal axis of the second steering nozzle. A first linkage has a first end and a second end. The second end is rotationally connected to the second steering nozzle. The second end is disposed on one side of the central longitudinal axis of the second steering nozzle.

In a further aspect, the first steering nozzle is rotationally mounted to a bracket about the first steering axis. The first end of the first linkage is rotationally connected to the bracket. The first steering axis and the central longitudinal axis of the first steering nozzle define a plane. When the central longitudinal axis of the second steering nozzle is disposed in the plane, the first linkage axis is disposed on a first side of the plane and the second linkage axis is disposed on a second side of the plane. The second side is opposite the first side.

In an additional aspect, when the central longitudinal axis of the second steering nozzle is disposed in the plane, the first end is disposed between the first and second steering axes.

In a further aspect, one of the first and second steering nozzles has a first boss formed about the second steering axis between first portions of the first and second steering nozzles such that the first steering nozzle contacts the second steering nozzle via the first boss. One of the first and second steering nozzles has a second boss formed about the second steering axis between second portions of the first and second steering nozzles such that the first steering nozzle contacts the second steering nozzle via the second boss, the second portions being opposite the first portions.

For purposes of this application, terms related to spatial orientation such as forwardly, rearwardly, left, and right, are as they would normally be understood by a driver of the watercraft sitting thereon in a normal driving position. It should be understood that terms related to spatial orientation when referring to the jet propulsion system alone should be understood as they would normally be understood when the jet propulsion system is installed on a watercraft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a personal watercraft and a jet boat. However, it should be understood that other types of watercraft are contemplated.

The general construction of a personal watercraft 10 in accordance with aspects of this invention will be described with respect to FIGS. 1-5. The following description relates to one way of manufacturing a personal watercraft. Obviously, those of ordinary skill in the watercraft art will recognize that there are other known ways of manufacturing and designing watercraft and that this invention would encompass other known ways and designs.

Figure 1:
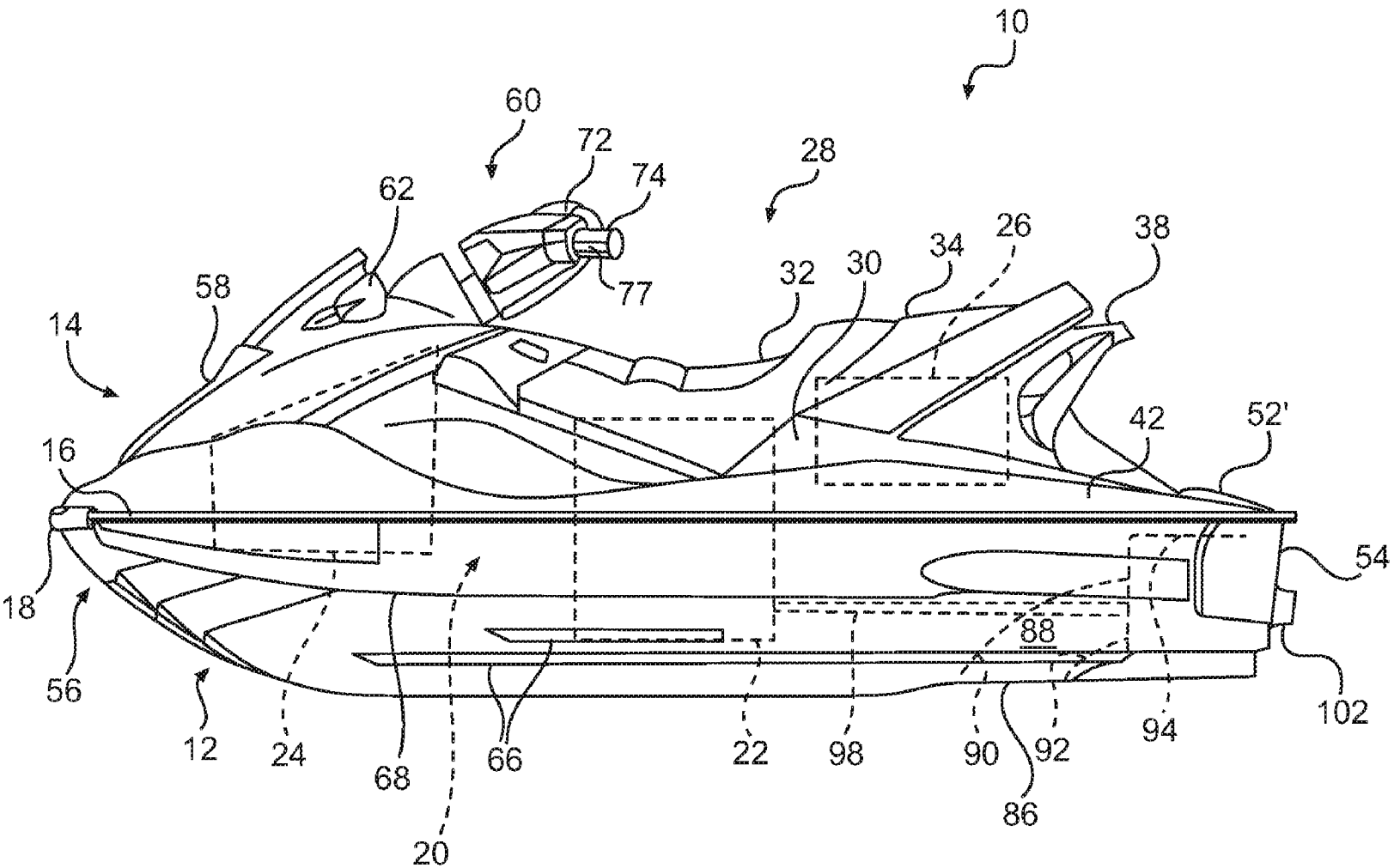
FIG. 1 illustrates a side view of a personal watercraft in accordance with aspects of the invention.

The watercraft 10 of FIG. 1 is made of two main parts, including a hull 12 and a deck 14. The hull 12 buoyantly supports the watercraft 10 in the water. The deck 14 is designed to accommodate a rider and one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked for example. The bumper 18 can extend around the bow 56, as shown, or around any portion or all of the seam 16.

The space between the hull 12 and the deck 14 forms a volume commonly referred to as the engine compartment 20. Shown schematically in FIG. 1, the engine compartment 20 accommodates an engine 22, as well as an exhaust system, fuel supply system, electrical system (battery, electronic control unit, etc.), air intake system, storage bins 24, 26, and other elements required or desirable in the watercraft 10.

Figure 2:
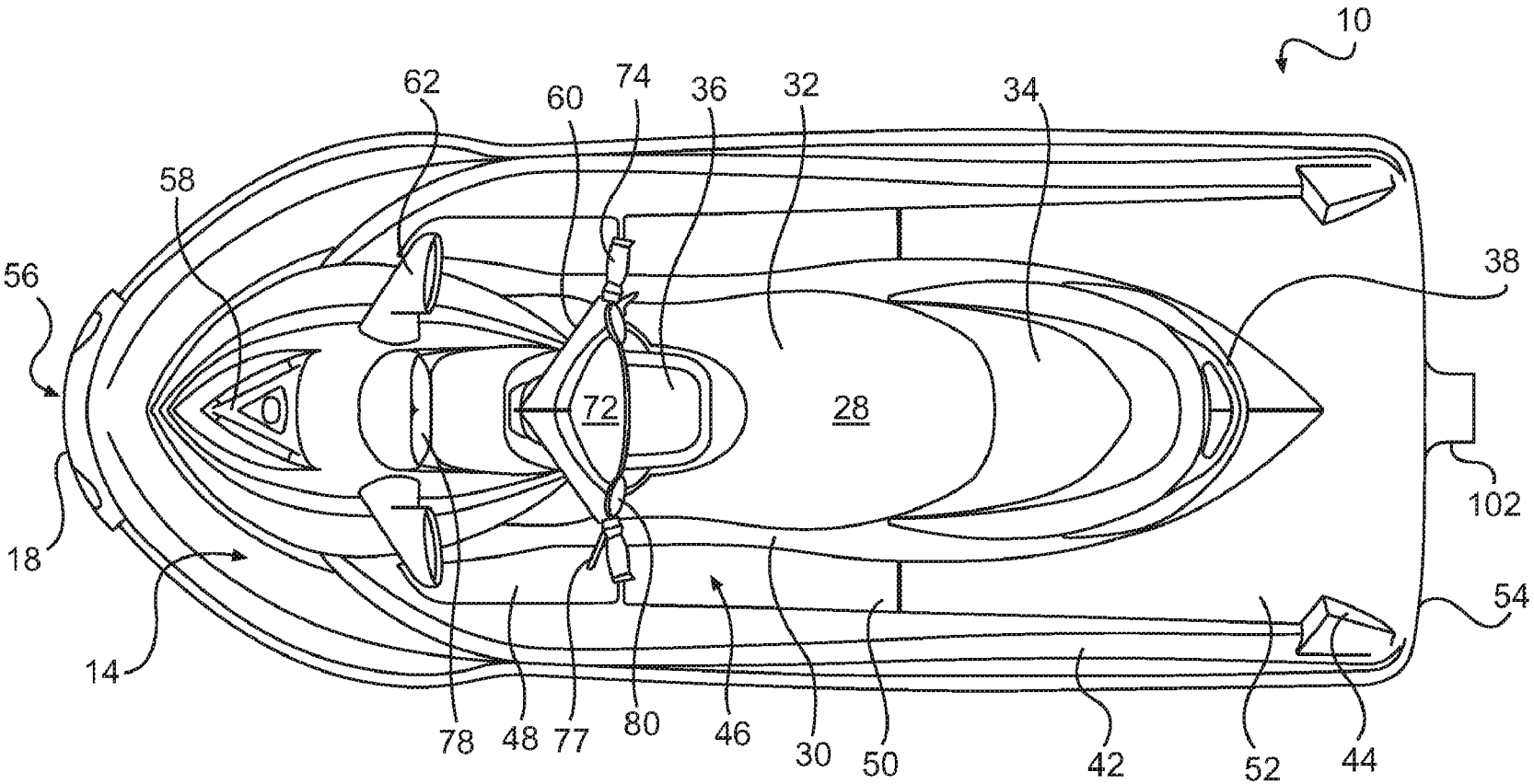
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 is sized to accommodate one or more riders. As seen in FIG. 2, the seat 28 includes a first, front seat portion 32 and a rear, raised seat portion 34 that accommodates a passenger. The first and second seat portions 32, 34 are removably attached to the pedestal 30 by a hook and tongue assembly (not shown) at the front of each seat portion and by a latch assembly (not shown) at the rear of each seat portion, or by any other known attachment mechanism. The seat portions 32, 34 can be individually tilted or removed completely. The seat portion 32 covers an engine access opening (in this case above engine 22) defined by a top portion of the pedestal 30 to provide access to the engine 22 (FIG. 1). The seat portion 34 covers a removable storage box 26 (FIG. 1). A "glove compartment" or small storage box 36 is provided in front of the seat 28.

Figure 4:
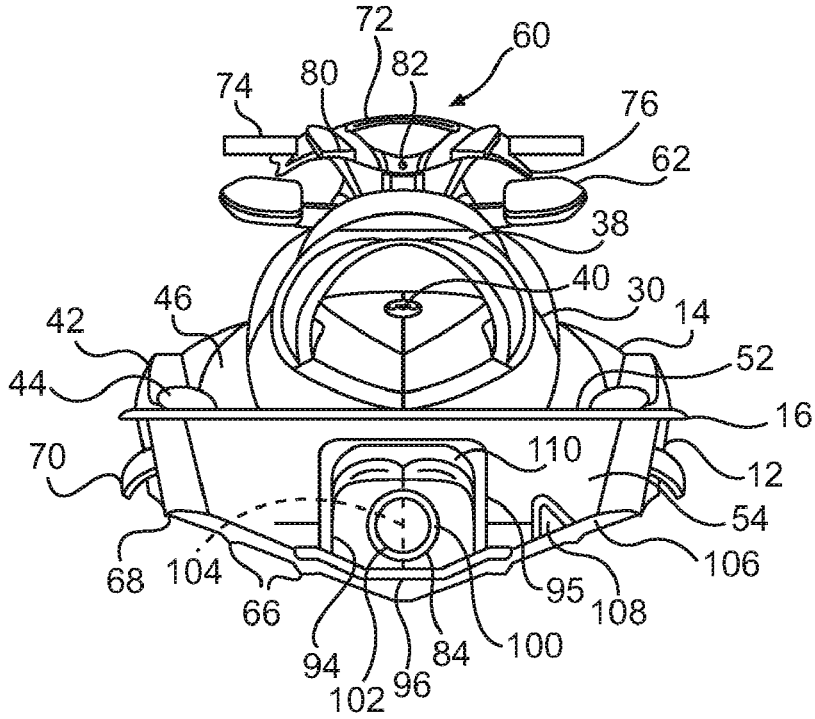
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
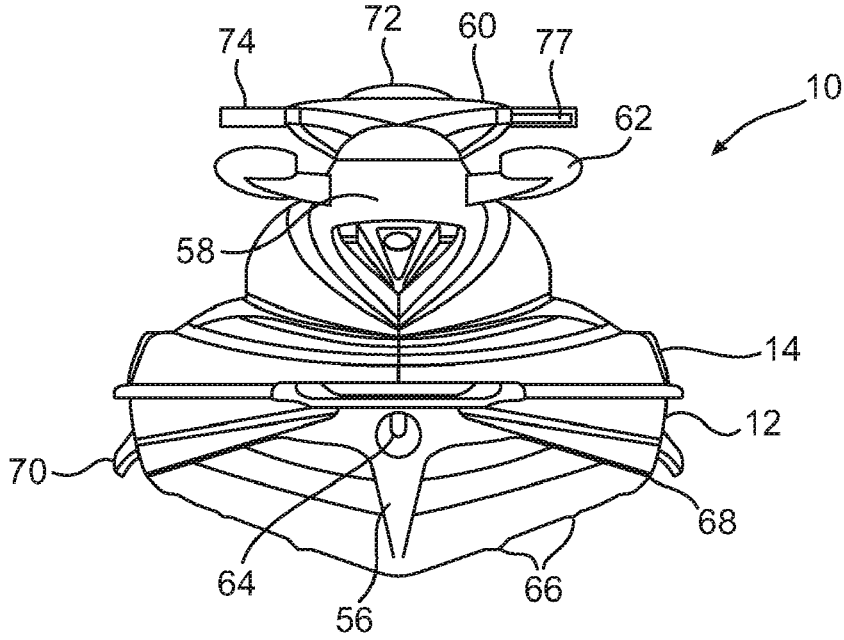
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a steering assembly including a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft is not in use or to attach to a winch when loading the watercraft 10 on a trailer, for instance.

Figure 5:
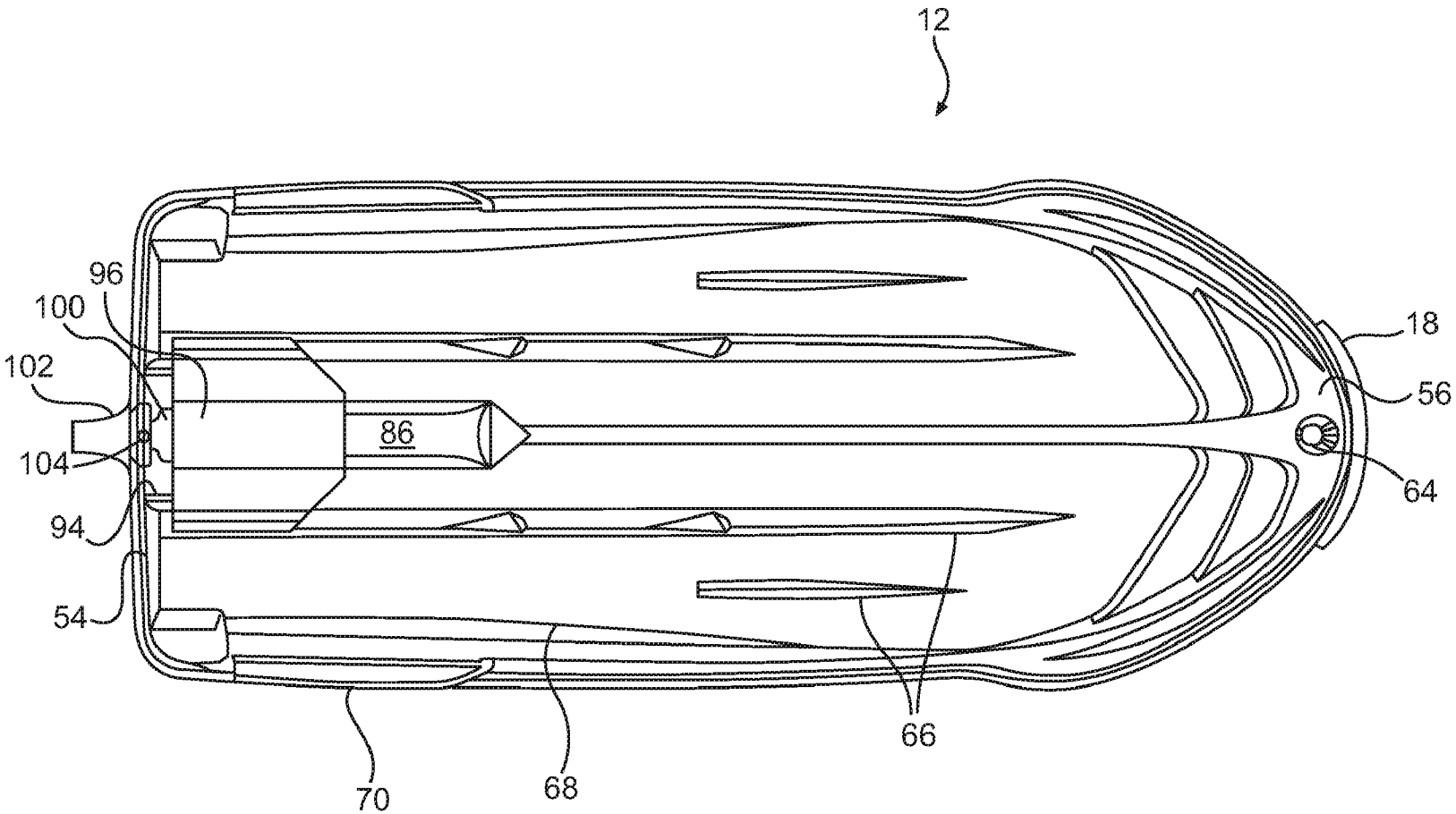
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are preferably fixed to the surface of the hull 12 and can be attached to the hull 12 by fasteners or molded therewith. Sometimes it may be desirable to adjust the position of the sponsons 70 with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72, that may be padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. The throttle operator 76 is preferably biased towards the idle position, such that when the driver of the watercraft lets go of the throttle operator 76, it will move to the idle position. The other of the steering handles 74 is provided with a lever 77 used by the driver to control one of a reverse gate 110 and trim of the watercraft 10.

As seen in FIG. 2, a display area or cluster 78 is located forwardly of the helm assembly 60. The display cluster 78 can be of any conventional display type, including a liquid crystal display (LCD), dials or LEDs (light emitting diodes). The central helm portion 72 has various buttons 80, which could alternatively be in the form of levers or switches, that allow the rider to modify the display data or mode (speed, engine rpm, time . . . ) on the display cluster 78.

The helm assembly 60 also has a key receiving post 82, preferably located near a center of the central helm portion 72. The key receiving post 82 is adapted to receive a key (not shown) that is used to allow starting of the watercraft 10. As is known, the key is typically attached to a safety lanyard (not shown). It should be noted that the key receiving post 82 may be placed in any suitable location on the watercraft 10.

Returning to FIGS. 1 and 5, it can be seen that the watercraft 10 is propelled by a jet propulsion system 84. The jet propulsion system 84 pressurizes water to create thrust. The water is first scooped from under the hull 12 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters the jet propulsion system 84. The jet propulsion system 84 is located in a formation in the hull 12, referred to as the tunnel 94 (FIG. 1). The tunnel 94 is defined at the front, sides, and top by walls formed by the hull 12 and is opened at the transom 54. The bottom of the tunnel 94 is closed by a ride plate 96. The ride plate 96 creates a surface on which the watercraft 10 rides or planes at high speeds.

Figure 8:
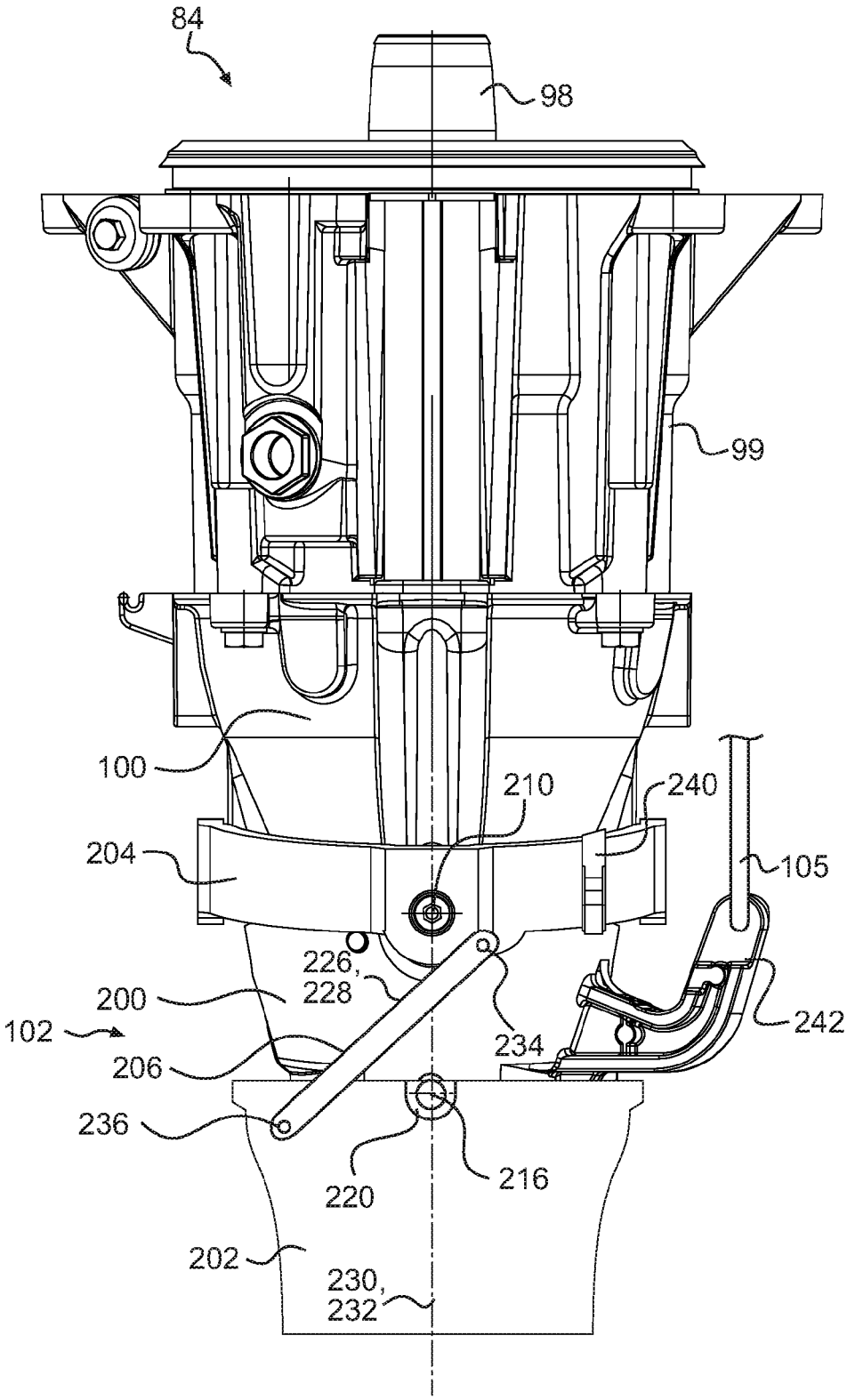
FIG. 8 is a top plan view of a jet propulsion system for the personal watercraft of FIG. 1 or the jet boat of FIG. 6 as arranged when the watercraft or jet boat is not being steered.

The jet propulsion system 84 includes a jet pump 99 (see FIG. 8). The forward end of the jet pump 99 is connected to the front wall of the tunnel 94. The jet pump 99 includes an impeller 101 and a stator 103 (see FIGS. 9 and 11). The impeller 101 is coupled to the engine 22 by one or more shafts 98 (FIG. 1), such as a driveshaft and an impeller shaft. The rotation of the impeller 101 pressurizes the water, which then moves over the stator 103 that is made of a plurality of fixed stator blades. The role of the stator blades is to decrease the rotational motion of the water so that almost all the energy given to the water is used for thrust, as opposed to swirling the water. Once the water leaves the jet pump 99, it goes through a venturi 100 that is connected to the rearward end of the jet pump 99. Since the venturi's exit diameter is smaller than its entrance diameter, the water is accelerated further, thereby providing more thrust. A steering nozzle assembly 102 is rotationally mounted relative to the venturi 100, as described in greater detail below.

The steering nozzle assembly 102 is operatively connected to the helm assembly 60 preferably via a push-pull cable 105, as described in greater detail below, such that when the helm assembly 60 is turned, the steering nozzle assembly 102 pivots. This movement redirects the pressurized water coming from the venturi 100, so as to redirect the thrust and steer the watercraft 10 in the desired direction.

The jet propulsion system 84 is provided with a reverse gate 110 which is movable between a stowed position where it does not interfere with a jet of water being expelled by the steering nozzle assembly 102 and a plurality of positions where it redirects the jet of water being expelled by the steering nozzle assembly 102. The specific construction of the reverse gate 110 will not be described in detail herein. However it will be understood by those skilled in the art that many different types of reverse gate could be provided without departing from the present invention.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 turns faster in correspondence. An electronic control unit (ECU) (not shown) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

Figure 6:
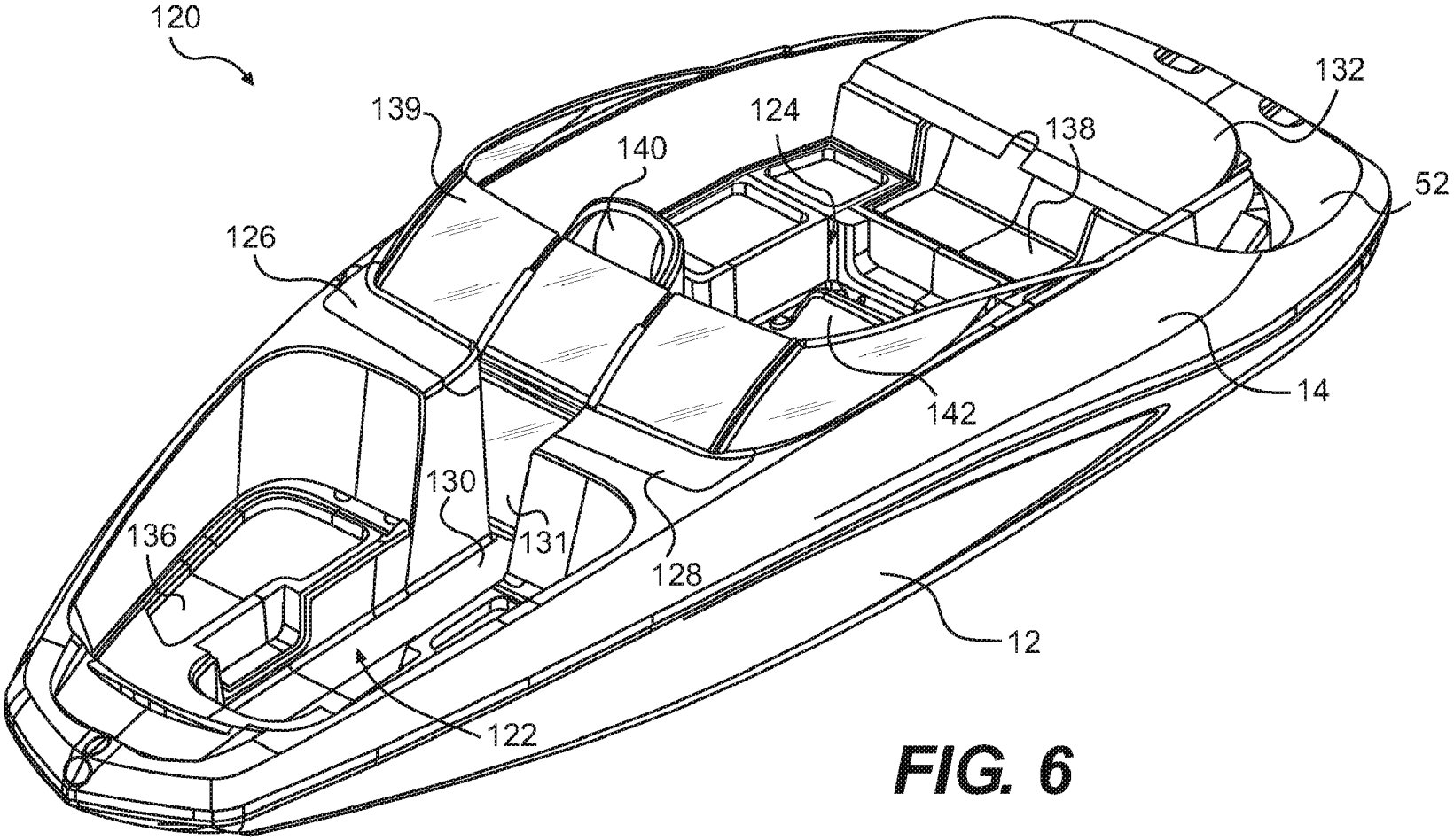
FIG. 6 is a perspective view, taken from a front, left side, of a jet boat in accordance with aspects of the invention.
Figure 7:
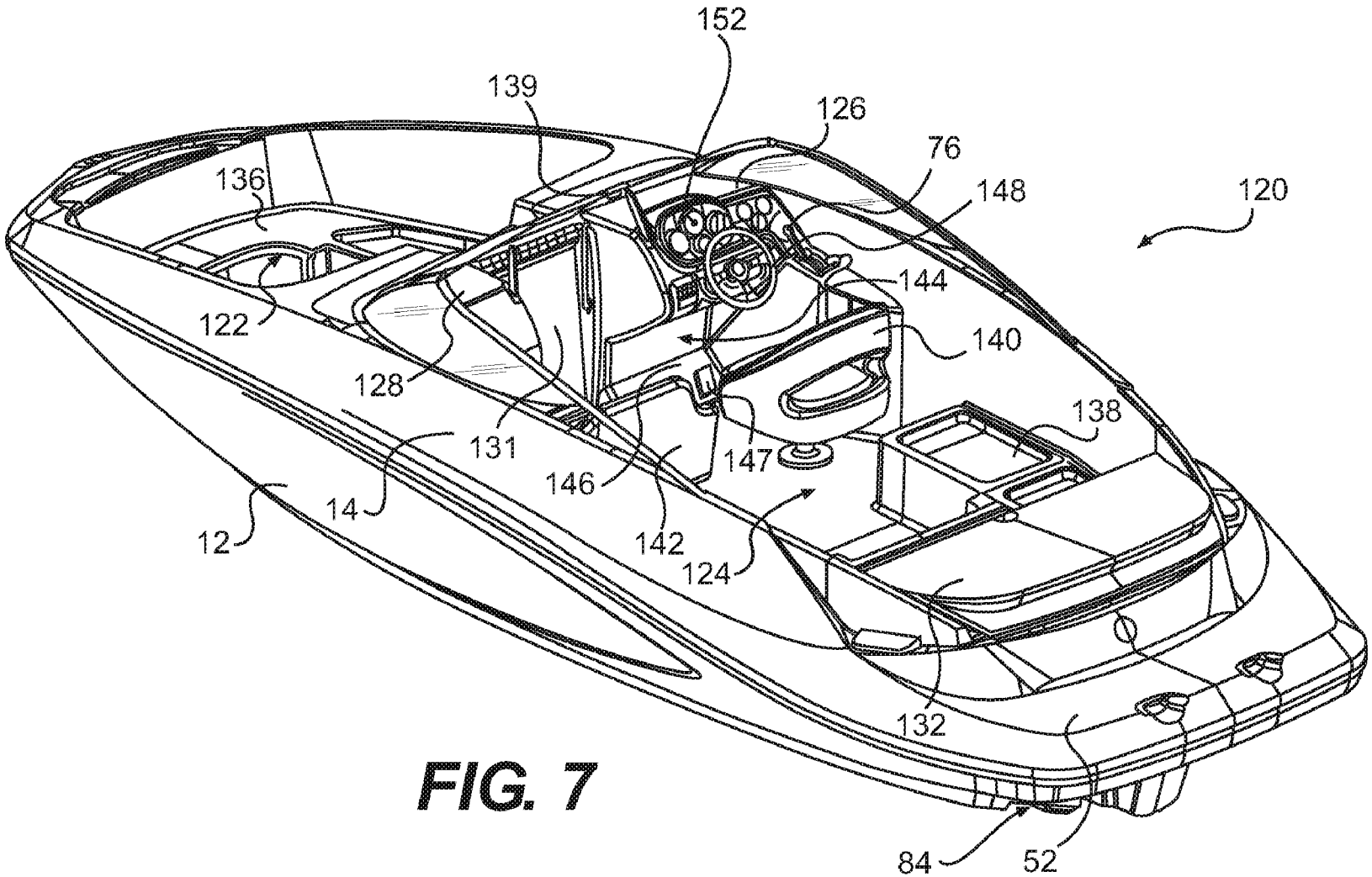
FIG. 7 is a perspective view, taken from a rear, left side, of the jet boat of FIG. 6.

The general construction of a jet boat 120 in accordance with aspects of this invention will now be described with respect to FIGS. 6 and 7. The following description relates to one way of manufacturing a jet boat. Obviously, those of ordinary skill in the jet boat art will recognize that there are other known ways of manufacturing and designing jet boats and that this invention would encompass other known ways and designs.

For simplicity, the components of the jet boat 120 which are similar in nature to the components of the personal watercraft 10 described above will be given the same reference numeral. It should be understood that their specific construction may vary however.

The jet boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one engine (not shown) is located between the hull 12 and the deck 14 at the back of the boat 120. The engine powers jet propulsion system 84 of the boat 120. The jet propulsion system 84 is of similar construction as the jet propulsion system 84 of the personal watercraft 10 described above, and in greater detail below, and will therefore not be described in detail here. It is contemplated that the boat 120 could have two engines and two jet propulsion systems 84. The engine is accessible through an engine cover 132 located behind the rearward passenger area 124. The engine cover 132 can also be used as a sundeck for a passenger of the boat 120 to sunbathe on while the boat 120 is not in motion. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 can swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A foot pedal 147 is provided on the footrest 146 which may be used to control a reverse gate or a trim of the jet boat 120. The left console 128 has a similar recess (not shown) to accommodate the feet of the passenger sitting in the passenger seat 142. The right console 126 accommodates all of the elements necessary to the driver to operate the boat 120. These include, but are not limited to, a steering assembly including a steering wheel 148, a throttle operator 76 in the form of a throttle lever, and an instrument panel 152. The instrument panel 152 has various dials indicating the watercraft speed, engine speed, fuel and oil level, and engine temperature. The speed of the watercraft is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Turning now to FIGS. 8 to 15, a first embodiment of the jet propulsion system 84 will be described in more detail. As previously mentioned, the jet propulsion system 84 includes the jet pump 99, the venturi 100 which is connected to the jet pump 99, and the steering nozzle assembly 102. The steering nozzle assembly 102 includes a first steering nozzle 200, a second steering nozzle 202, a bracket in the form of a trim support 204, and a linkage 206.

Figure 9:
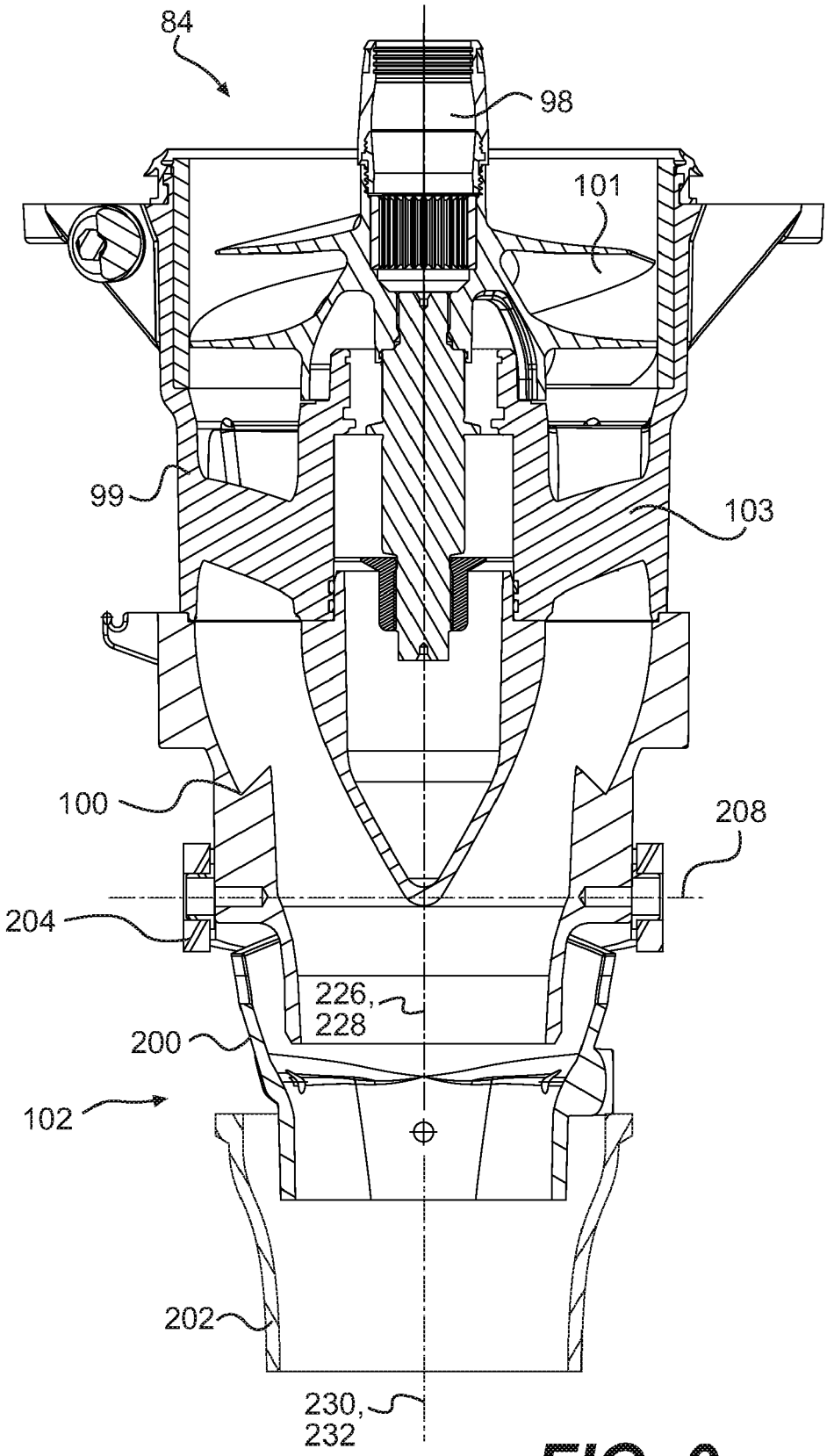
FIG. 9 is a horizontal cross-section of the jet propulsion system of FIG. 8 taken through the middle thereof.

The trim support 204 is rotationally mounted to the venturi 100 about a laterally and horizontally extending trim axis 208 (FIG. 9). It is contemplated that the trim support 204 could alternatively be mounted to the tunnel 94.

Figure 11:
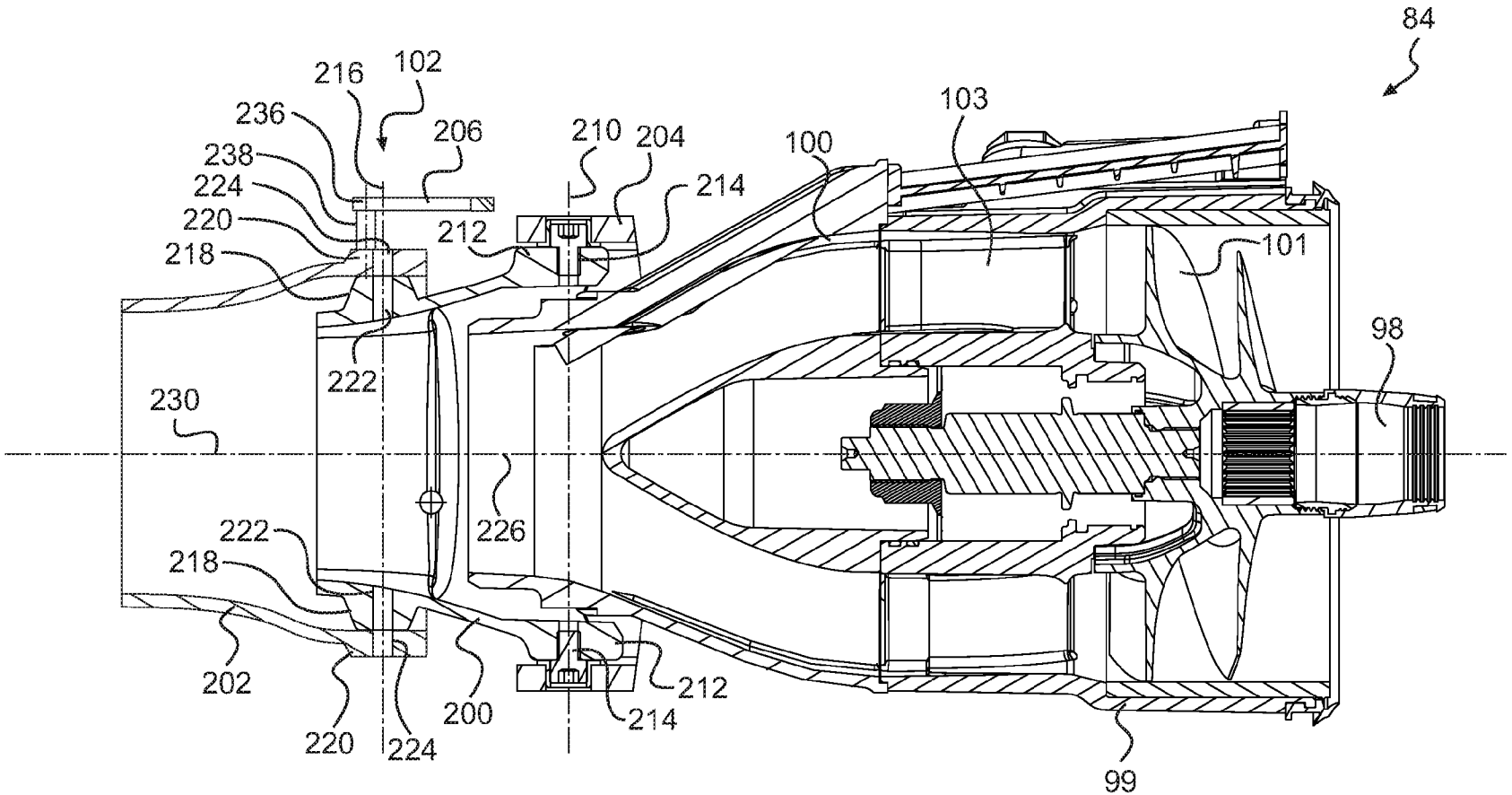
FIG. 11 is a vertical cross-section of the jet propulsion system of FIG. 8 taken through the middle thereof.

The first steering nozzle 200 is rotationally mounted about a first vertically extending steering axis 210. As best seen in FIG. 11, the first steering nozzle 200 has bosses 212 provided around the apertures 214 at the top and bottom thereof to provide contact surfaces between the trim support 204 and the nozzle 200 and to allow a sturdy connection between the two. It is contemplated that the bosses 212 could alternatively be provided on the trim support 204.

The second steering nozzle 202 is rotationally mounted about a second vertically extending steering axis 216 disposed rearwardly of the first steering axis 210. As best seen in FIG. 11, the first and second steering nozzles 200, 202 have bosses 218, 220 provided around the apertures 222, 224 at the top and bottom thereof to provide contact surfaces between the second steering nozzle 202 and the first steering nozzle 200 and to allow a sturdy connection between the two. It is contemplated that the bosses 218, 220 could alternatively be provided on only one of the first and second steering nozzle 200, 202 between the first and second steering nozzles 200, 202. Alternatively, one of the first and second steering nozzles 200, 202 could have a boss 218 or 220 between the two steering nozzles 200, 202 at the top thereof, and the other of the first and second steering nozzles 200, 202 could have a boss 218 or 220 between the two steering nozzles 200, 202 at the bottom thereof.

Figure 10:
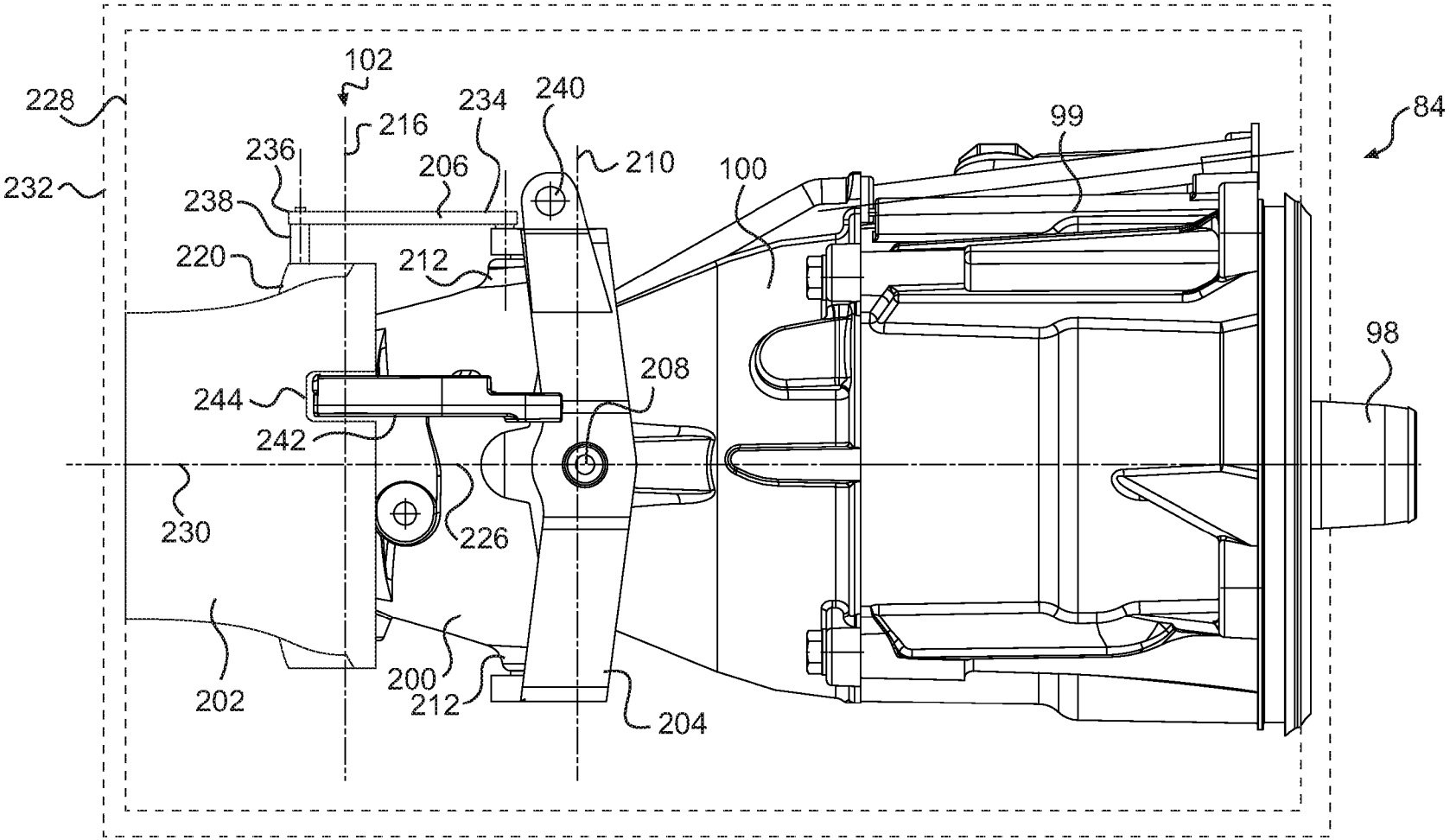
FIG. 10 is a left side elevation view of the jet propulsion system of FIG. 8.

The first steering nozzle 200 has a first central longitudinal axis 226. The first steering axis 210 is perpendicular to the first central longitudinal axis 226. As best seen in FIG. 10, the first steering axis 210 and the first central longitudinal axis 226 define a first generally vertical plane 228. The first steering axis 210 and the first central longitudinal axis 226 therefore extend and are contained in the first generally vertical plane 228. Similarly, the second steering nozzle 202 has a second central longitudinal axis 230. The second steering axis 216 is perpendicular to the second central longitudinal axis 230. As best seen in FIG. 10, the second steering axis 216 and the second central longitudinal axis 230 define a second generally vertical plane 232. The second steering axis 216 and the second central longitudinal axis 230 therefore extend and are contained in the second generally vertical plane 232. It should be understood that the boundaries for planes 228 and 232 are for illustrative purposes only since planes are unbounded in two dimensions. It should also be understood that, when viewed from above, as seen in FIG. 8 for example, the planes 228, 232 and their corresponding central longitudinal axes 226, 230 appear as a single line representing both the plane and the axis. When the two steering nozzles 200, 202 are arranged as shown in FIGS. 8-13 (i.e. when the watercraft is not being steered), the two generally vertical planes 228, 232 are generally co-planar. The term "generally" is used here to take into account misalignments which may occur due to manufacturing tolerances.

The linkage 206 is disposed above the first and second steering nozzles 200, 202. One end 234 of the linkage 206 is rotationally connected to the top of the trim support 204. The other end 236 of the linkage 206 is rotationally connected to a post 238 extending from the second steering nozzle 202. When the first and second steering nozzles 200, 202 are arranged as shown in any one of FIGS. 8-13, it can be seen that the end 234 of the linkage 206 is located on one side of the planes 228, 232 and between (in a longitudinal direction) the steering axes 210, 216 and the end 236 of the linkage 206 is disposed on the other side of the planes 228, 232. As will be explained in greater detail below, the linkage 206 causes the second steering nozzle 202 to be rotated relative to the first steering nozzle 200 when the first steering nozzle is rotated relative to the venturi 100.

Figure 12:
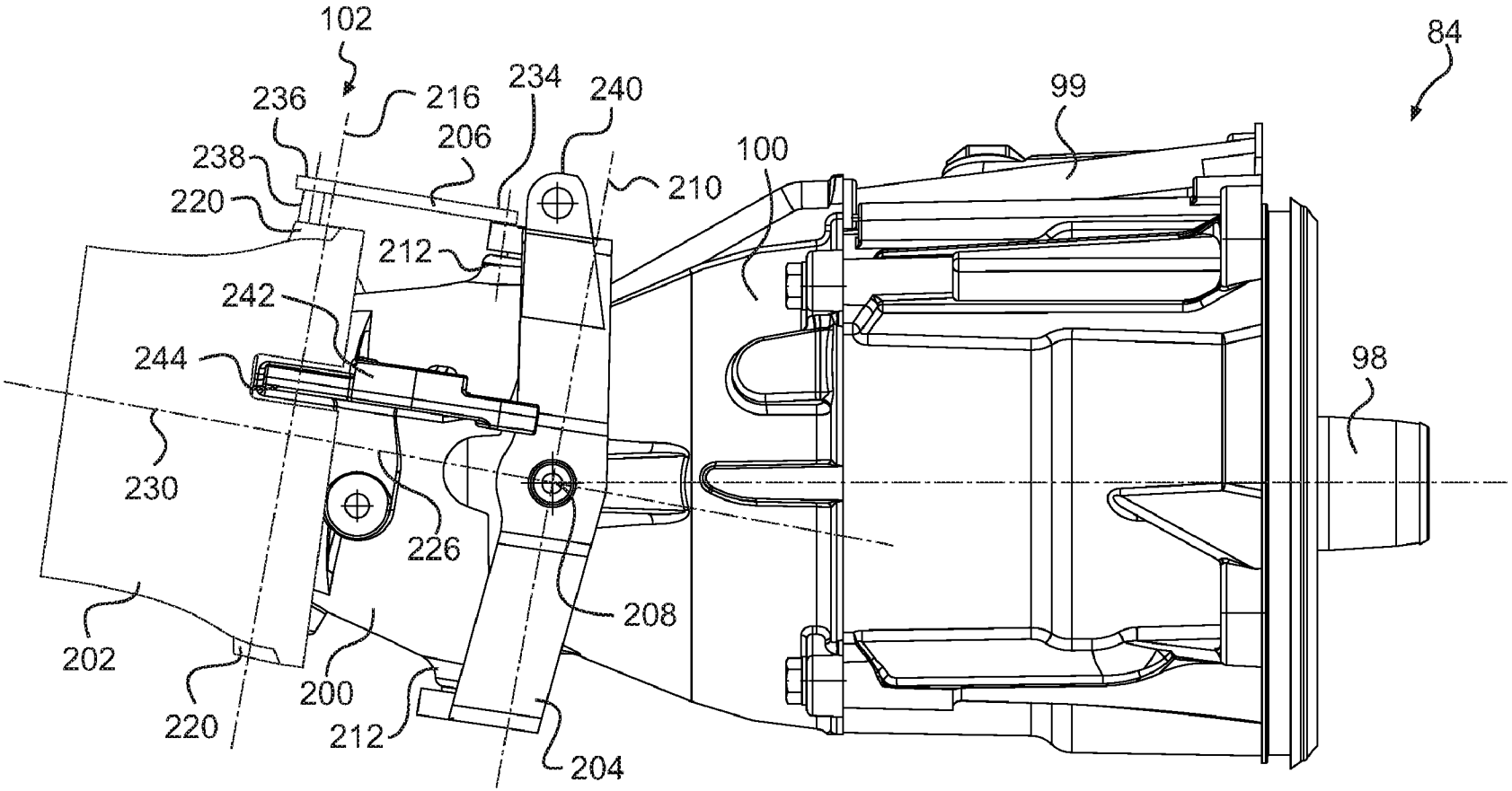
FIG. 12 is a left side elevation view of the jet propulsion system of FIG. 8 in a trim up position.
Figure 13:
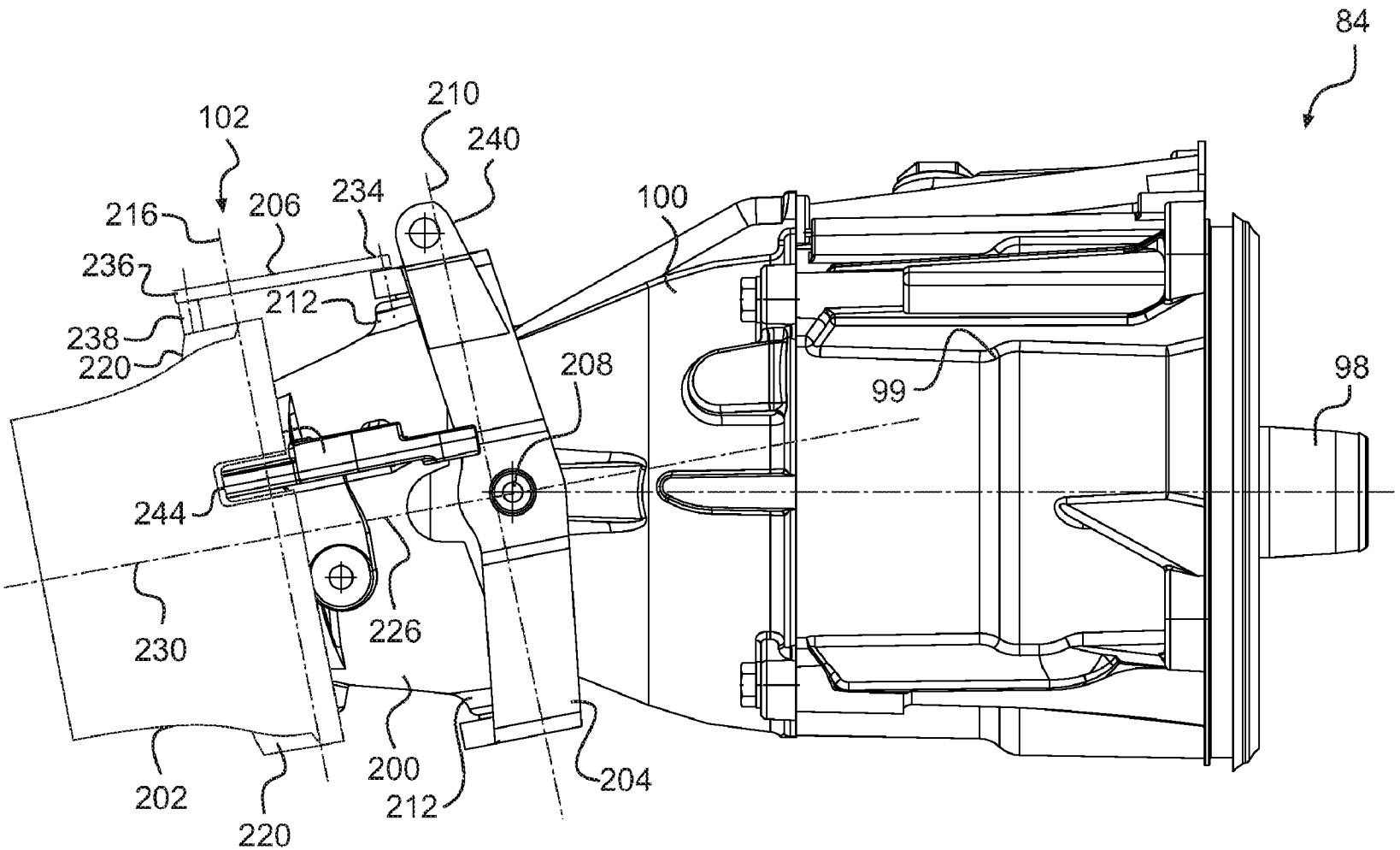
FIG. 13 is a left side elevation view of the jet propulsion system of FIG. 8 in a trim down position.

Turning now to FIGS. 10, 12, and 13, it can be seen that the trim support 204 is provided with a tab 240. A button or lever (not shown) to be operated by the driver of the watercraft is operatively connected to a mechanism or an electric motor (not shown). The mechanism or electric motor is connected to a push-pull cable or other linkage (not shown) which is connected to the tab 240, such that operating the button or lever pushes or pulls on the tab 240. When the cable or linkage pulls on the tab 240 (towards the right in FIG. 10), the trim support 204 rotates about the trim axis 208 in one direction (clockwise in the Figs.) which causes the first and second steering nozzles 200, 202 (and their corresponding steering axes 210, 216), and the linkage 206 to also rotate in the same direction about the trim axis 208 as shown in FIG. 12. This is known as the trim up position. When the cable or linkage pushes on the tab 240 (towards the left in FIG. 10), the trim support 204 rotates about the trim axis 208 in the other direction (counter-clockwise in the Figs.) which causes the first and second steering nozzles 200, 202 (and their corresponding steering axes 210, 216), and the linkage 206 to also rotate in the same direction about the trim axis 208 as shown in FIG. 13. This is known as the trim down position. Modifying the trim as shown adjusts the attitude (i.e. pitch) or the watercraft as it moves through water and, when properly adjusted, can help minimize porpoising of the watercraft. It is contemplated that the button or lever could be omitted and that trim could be controlled automatically using various inputs from sensors on the watercraft. U.S. Pat. No. 5,593,329, issued Jan. 14, 1997, the entirety of which is incorporated herein by reference, describes one possible embodiment of an electrically powered trim adjustment system. Although the system described in this patent is for a jet propulsion system having a single nozzle, it is contemplated that it could be used on the jet propulsion system of the present invention.

Figure 14:
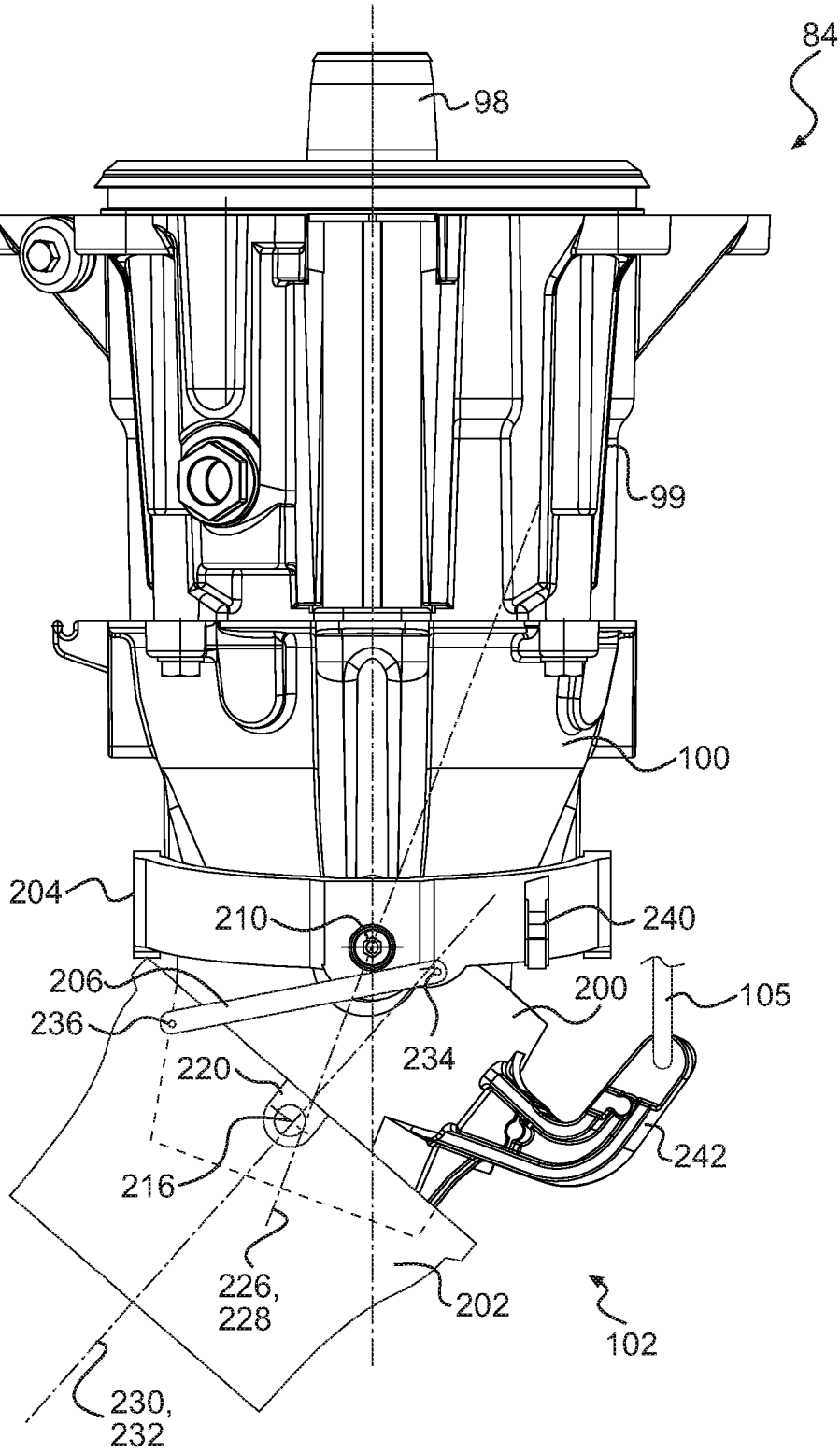
FIG. 14 is a top plan view of the jet propulsion system FIG. 8 steered towards the left.
Figure 15:
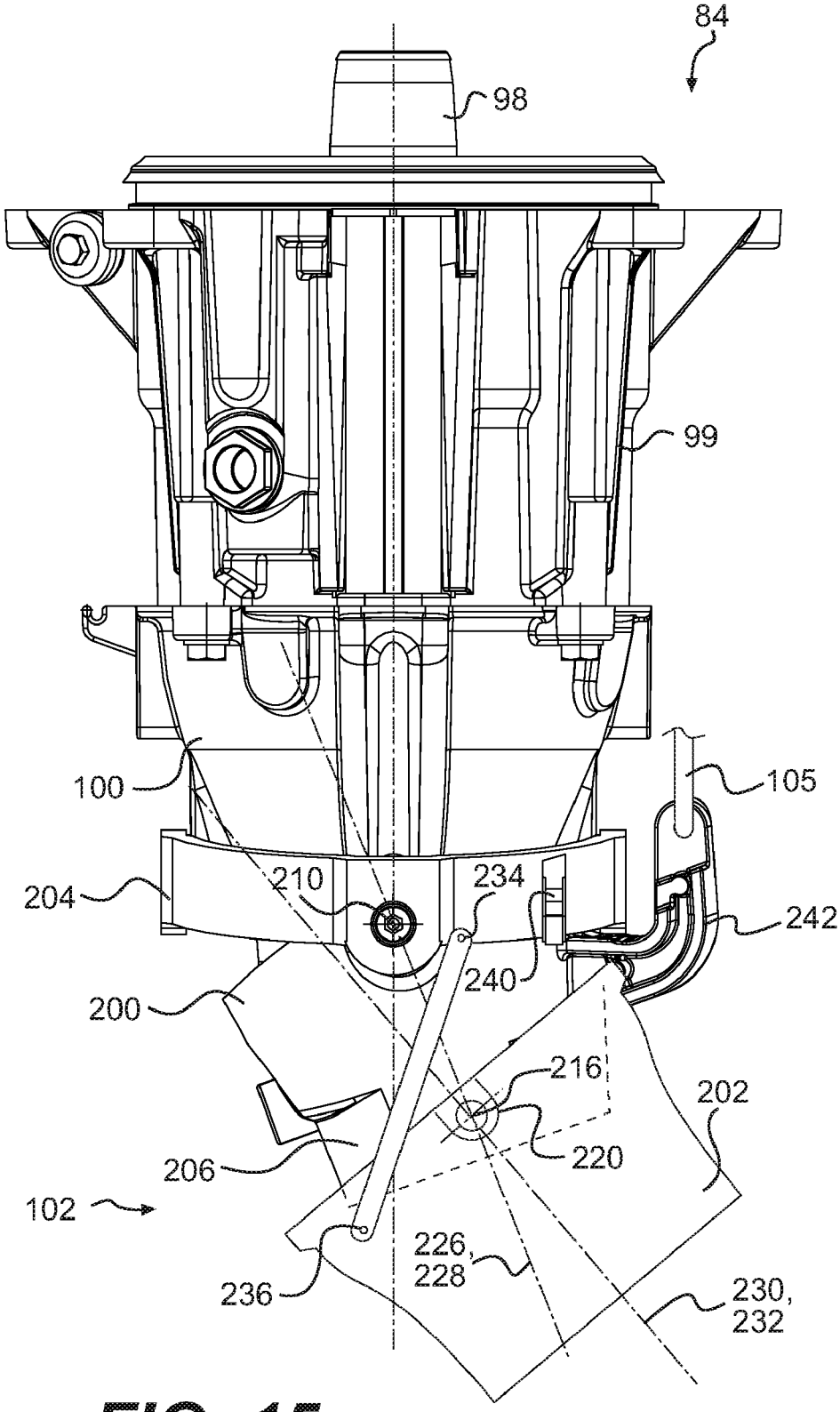
FIG. 15 is a top plan view of the jet propulsion system FIG. 8 steered towards the right.

Turning now to FIGS. 8, 14, and 15, the steering operation of the jet propulsion system 84 will be explained. A steering arm 242 is connected to a right side of the first steering nozzle 200. It is contemplated that the steering arm 242 could be connected to the other side of the first steering nozzle 200. It is also contemplated that a steering arm 242 could be provided on each side of the first steering nozzle 200 with each steering arm being connected to a cable 105. The steering arm 242 is connected to the push-pull cable 105 (or other linkage) which is connected to the rest of the steering assembly of the watercraft. Actuating the steering assembly, by turning the helm assembly 60 of the watercraft 10 for example, pushes or pulls on the cable 105 which causes the first steering nozzle 200 to rotate relative to the venturi 100 about the first steering axis 210 and the second steering nozzle 202 to rotate relative to the first steering nozzle 200 about the second steering axis 216 regardless of the position of the trim support 204. In an alternative embodiment, the steering arm 242 is connected to one side of the second steering nozzle 202, such that pushing or pulling on the cable 105 would result in the same motion as when the steering arm 242 is connected to the first steering nozzle 200.

As seen in FIG. 14, when the cable 105 pushes (down in FIG. 14) on the steering arm 242, the first steering nozzle rotates about the first steering axis 210 relative to the venturi 100 towards the left (clockwise in FIG. 14). This causes the second steering axis 216 to also rotate in the same direction about the first steering axis 210. The end 234 of the linkage 206 does not rotate with the first steering nozzle 200 and since the length of the linkage 206 is fixed, the linkage 206 rotates about its end 234 clockwise (as shown in FIG. 14) and its end 236 pulls (up in FIG. 14) on the second steering nozzle 202 causing it to rotate left (clockwise) about the second steering axis 216 relative to the first steering nozzle 200. This redirects the flow of water being expelled by the venturi 100 towards the left and causes the watercraft to turn left.

As seen in FIG. 15, when the cable 105 pulls (up in FIG. 15) on the steering arm 242, the first steering nozzle rotates about the first steering axis 210 relative to the venturi 100 towards the right (counter-clockwise in FIG. 15). This causes the second steering axis 216 to also rotate in the same direction about the first steering axis 210. Since the end 234 of the linkage 206 does not rotate with the first steering nozzle 200 and since the length of the linkage 206 is fixed, the linkage 206 rotates about its end 234 counter-clockwise (as shown in FIG. 15) and its end 236 pushes (down in FIG. 15) on the second steering nozzle 202 causing it to rotate right (counter-clockwise) about the second steering axis 216 relative to the first steering nozzle 200. This redirects the flow of water being expelled by the venturi 100 towards the right and causes the watercraft to turn right. To prevent the second steering nozzle 202 from coming into contact with the steering arm 242, the second steering nozzle 202 is provided with an indentation 244 into which part of the steering arm 242 is received when the second steering nozzle 202 is turned to the right as shown.

By using the two steering nozzles 200, 202, the flow of water being expelled by the venturi 100 is redirected by a first amount by the first steering nozzle 200 and by a second amount by the second steering nozzle 202. This dual-stage redirection allows the flow of water to be redirected by a greater amount than in the prior art while avoiding the previously mentioned disadvantages. It is contemplated that three or more steering nozzles could be connected in a similar matter to further increase the amount by which the flow of water could be redirected. In a preferred embodiment, the first steering nozzle 200 can be rotated about the first steering axis 210 by a maximum angle A and the second steering nozzle 202 can be rotated about the second steering axis 216 by the same angle A, thereby redirecting the flow of water from the venturi 100 by an angle of 2×A, which is twice the amount that would otherwise be possible by using a single steering nozzle. By changing the position of where the ends 234, 236 of the linkage 206 are connected to the trim support 204 and second steering nozzle 202, and by changing the length of the linkage 206 it is possible to change the ratio of rotation of the second steering nozzle 202 versus the rotation of the first steering nozzle 200. In the above-mentioned preferred embodiment, the ratio is 1:1. However, other ratios are also contemplated depending on the amount of steering necessary for a specific application. For example, for a ratio of 0.7:1, when the first steering nozzle 200 rotates by 20 degrees, the second steering nozzle 202 rotates by 14 degrees, and the flow of water expelled by the venturi 100 is therefore redirected by 34 degrees.

Figure 16:
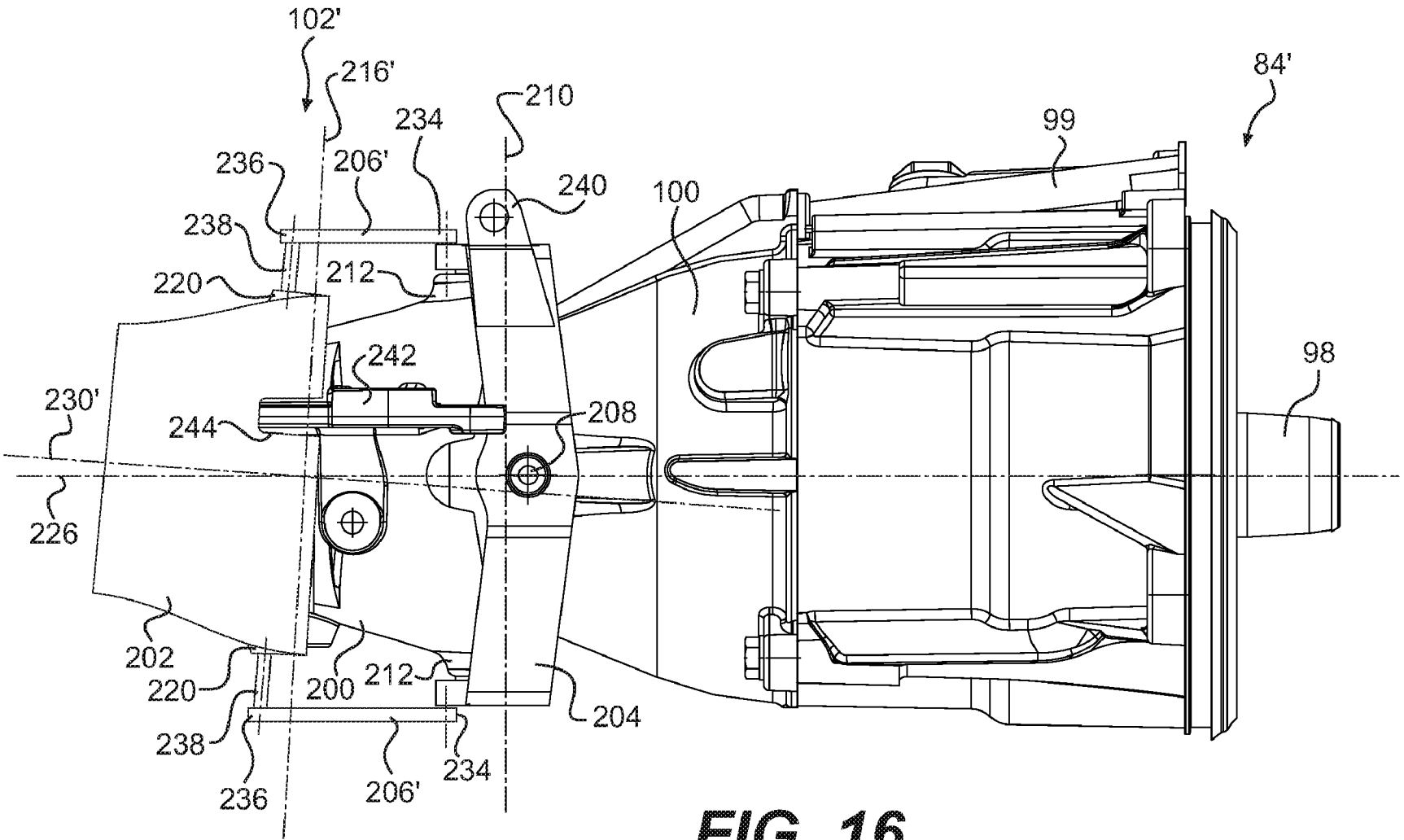
FIG. 16 is a left side elevation view of an alternative embodiment of a jet propulsion system.
Figure 17:
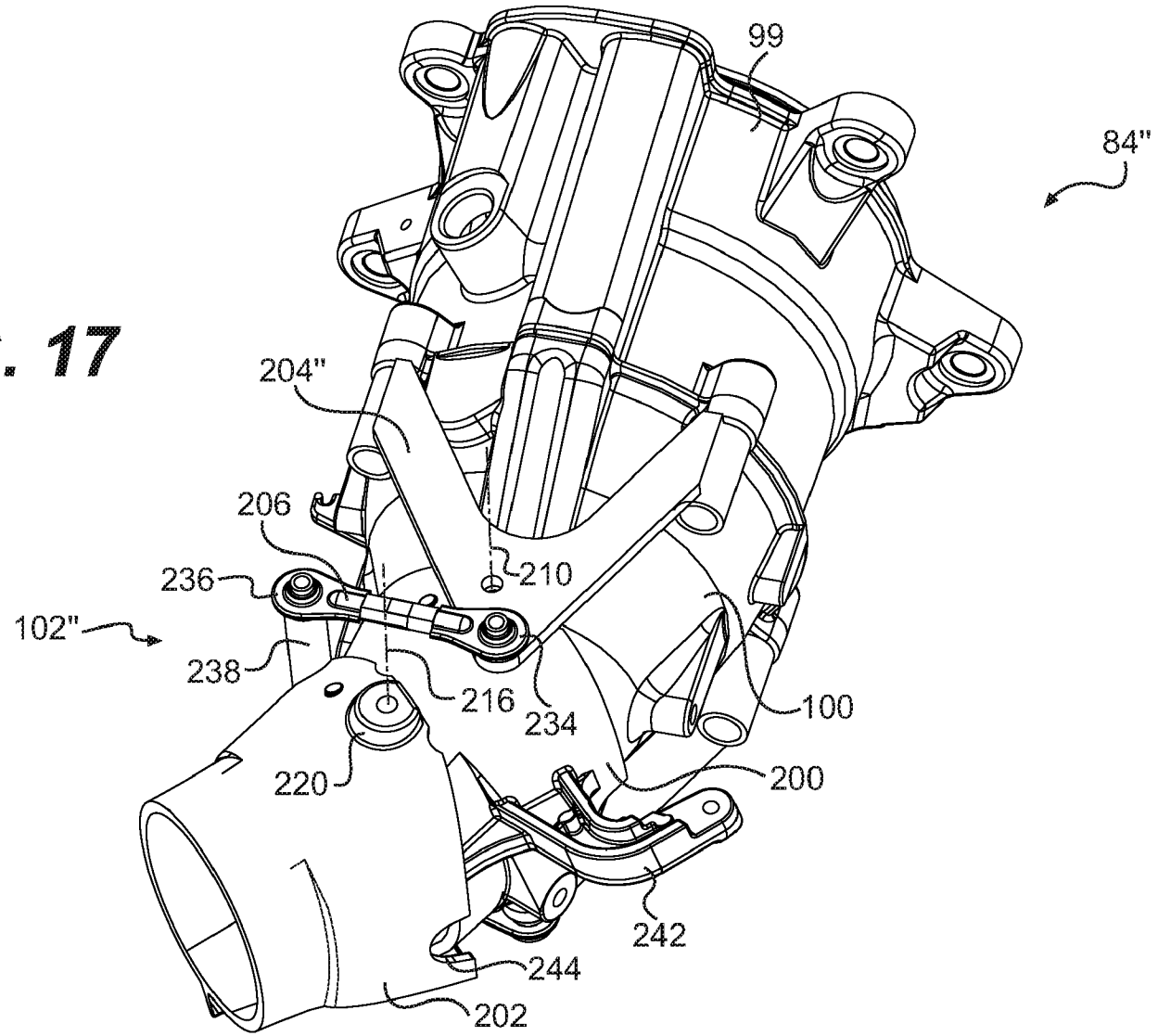
FIG. 17 is perspective view, taken from a rear, right side, of another alternative embodiment of a jet propulsion system.

Turning now to FIGS. 16 and 17, two alternative embodiments of the jet propulsion system 84 (84' and 84" respectively) will be described. For simplicity, elements of the jet propulsion systems 84' and 84" which are similar to those of the jet propulsion system 84 have been labelled with the same reference number and will not be described in detail.

FIG. 16 illustrates a jet propulsion system 84' where the second steering axis 216' about which the second steering nozzle 202 rotates is angled relative to the vertical when the steering support 204 is in a neutral position as shown, and therefore the central longitudinal axis 230' of the second steering nozzle 202 is angled relative to the horizontal. This adds a vertical component to the jet of water being expelled by the jet propulsion system 84' which enhances the maneuverability of the watercraft. Since the steering axes 210, 216' are not parallel, the linkage 206' connecting the trim support 204 to the second steering nozzle 202 provides for some freedom of motion at one or both ends 234, 236 thereof. As can be seen, the jet propulsion system 84' is provided with two linkages 206', one above and one below the steering nozzles 200, 202. The ends 234 of the linkages 206' preferably rotate about a common axis. Similarly, the ends 236 of the linkages 206' preferably also rotate about a common axis. It is contemplated that the jet propulsion system 84 described above and the jet propulsion system 84" described below could also be provided with two linkages 206.

FIG. 17 illustrates a jet propulsion system 84" where the trim support 204 has been replaced by a bracket 204". The bracket 204" is connected to the jet pump 99, but could alternatively be connected to the venturi 100 or the tunnel 94. Both the first steering nozzle 200 and the end 234 of the linkage 206 are connected to the bracket 204". It is contemplated the first steering nozzle 200 could alternatively be connected directly to the venturi 100 and only the end 234 of the linkage 206 would be connected to the bracket 204". It is also contemplated that the bracket 204" could be omitted and that the first steering nozzle 200 would be connected directly to the venturi 100 and the end 234 of the linkage 206 would be connected directly to the venturi 100 or the jet pump 99.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:

a hull;

a deck disposed on the hull;

an engine supported by the hull;

a jet pump connected to the hull and being operatively connected to the engine;

a venturi connected to the jet pump;

a first steering nozzle rotationally mounted relative to the venturi about a first steering axis, the first steering axis extending in a first generally vertical plane containing a central longitudinal axis of the first steering nozzle;

a second steering nozzle rotationally mounted relative to the first steering nozzle about a second steering axis, the second steering axis extending in a second generally vertical plane containing a central longitudinal axis of the second steering nozzle, the second steering axis being disposed rearwardly of the first steering axis;

a steering assembly disposed at least in part on the deck and being operatively connected to the first steering nozzle for rotating the first steering nozzle relative to the venturi about the first steering axis, rotation of the first steering nozzle relative to the venturi about the first steering axis in a steering direction causing the second steering axis to rotate about the first steering axis in the steering direction and the second steering nozzle to rotate relative to the first steering nozzle about the second steering axis in the steering direction;

a bracket mounted to one of the jet pump, the venturi, and the hull, the first steering nozzle being rotationally mounted to one of the bracket and the venturi about the first steering axis; and a first linkage having a first end and a second end, the first end being rotationally connected to the bracket and the second end is rotationally connected to the second steering nozzle;

wherein when the first and second generally vertical planes are generally co-planar, the first end is disposed on a first side of the generally vertical planes and the second end is disposed on a second side of the generally vertical planes, the second side being opposite the first side.

2. The watercraft of claim 1, further comprising a second linkage disposed below the first steering nozzle, the second linkage having a first end and a second end;

wherein the first end of the second linkage is operatively rotationally connected to one of the bracket and the venturi, and the second end is rotationally connected to the second steering nozzle;

wherein when the first and second generally vertical planes are generally co-planar, the first end of the second linkage is disposed on the first side of the generally vertical planes and the second end of the second linkage is disposed on the second side of the generally vertical planes; and wherein the first linkage is disposed above the first steering nozzle.

3. The watercraft of claim 1, wherein when the first and second generally vertical planes are generally co-planar, the first end is disposed rearwardly of the first steering axis and forwardly of the second steering axis.

4. The watercraft of claim 1, further comprising a steering arm connected to a side of the first steering nozzle, the steering assembly being operatively connected to the steering arm such that pulling on the steering arm towards a front of the watercraft causes the first steering nozzle to rotate about the first steering axis in one steering direction;

wherein the second steering nozzle has an indentation on one side thereof; and wherein when the second steering nozzle is rotated relative to the first steering nozzle about the second steering axis in the one steering direction, part of the steering arm is received in the indentation.

5. The watercraft of claim 1, wherein one of the first and second steering nozzles has a first boss formed about the second steering axis between upper portions of the first and second steering nozzles such that the first steering nozzle contacts the second steering nozzle via the first boss; and wherein one of the first and second steering nozzles has a second boss formed about the second steering axis between lower portions of the first and second steering nozzles such that the first steering nozzle contacts the second steering nozzle via the second boss.

6. A watercraft comprising:

a hull;

a deck disposed on the hull;

an engine supported by the hull;

a jet pump connected to the hull and being operatively connected to the engine;

a venturi connected to the jet pump;

a first steering nozzle rotationally mounted relative to the venturi about a first steering axis, the first steering axis extending in a first generally vertical plane containing a central longitudinal axis of the first steering nozzle;

a second steering nozzle rotationally mounted relative to the first steering nozzle about a second steering axis, the second steering axis extending in a second generally vertical plane containing a central longitudinal axis of the second steering nozzle, the second steering axis being disposed rearwardly of the first steering axis;

a steering assembly disposed at least in part on the deck and being operatively connected to the first steering nozzle for rotating the first steering nozzle relative to the venturi about the first steering axis, rotation of the first steering nozzle relative to the venturi about the first steering axis in a steering direction causing the second steering axis to rotate about the first steering axis in the steering direction and the second steering nozzle to rotate relative to the first steering nozzle about the second steering axis in the steering direction; and a trim support rotationally mounted relative to the venturi about a trim axis to one of the jet pump, the venturi, and the hull, the trim axis extending generally laterally and horizontally, the first steering nozzle being rotationally mounted to the trim support, and the first and second steering axes being rotatable about the trim axis with the trim support.

7. A marine jet propulsion system comprising:

a jet pump;

a venturi connected to the jet pump;

a first steering nozzle rotationally mounted relative to the venturi about a first steering axis, the first steering axis extending in a first generally vertical plane containing a central longitudinal axis of the first steering nozzle;

a second steering nozzle rotationally mounted relative to the first steering nozzle about a second steering axis, the second steering axis extending in a second generally vertical plane containing a central longitudinal axis of the second steering nozzle, the second steering axis being disposed rearwardly of the first steering axis, rotation of the first steering nozzle relative to the venturi about the first steering axis in a steering direction causing the second steering axis to rotate about the first steering axis in the steering direction and the second steering nozzle to rotate relative to the first steering nozzle about the second steering axis in the steering direction;

a bracket mounted to one of the jet pump and the venturi, the first steering nozzle being rotationally mounted to one of the bracket and the venturi about the first steering axis; and a first linkage having a first end and a second end, the first end being rotationally connected to the bracket, the second end being rotationally connected to the second steering nozzle; and wherein when the first and second generally vertical planes are generally co-planar, the first end is disposed on a first side of the generally vertical planes and the second end is disposed on a second side of the generally vertical planes, the second side being opposite the first side.

8. The jet propulsion system of claim 7, wherein the bracket is a trim support rotationally mounted relative to the venturi about a trim axis, the trim axis extending generally laterally and horizontally;

wherein the first steering nozzle is rotationally mounted to the trim support; and wherein the first and second steering axes are rotatable about the trim axis with the trim support.

9. The jet propulsion system of claim 7, further comprising a second linkage disposed below the first steering nozzle, the second linkage having a first end and a second end;

wherein the first end of the second linkage is operatively rotationally connected to one of the bracket and the venturi, and the second end is rotationally connected to the second steering nozzle;

wherein when the first and second generally vertical planes are generally co-planar, the first end of the second linkage is disposed on the first side of the generally vertical planes and the second end of the second linkage is disposed on the second side of the generally vertical planes; and wherein the first linkage is disposed above the first steering nozzle.

10. The jet propulsion system of claim 7, wherein when the first and second generally vertical planes are generally co-planar, the first linkage axis is disposed rearwardly of the first steering axis and forwardly of the second steering axis.

11. The jet propulsion system of claim 7, further comprising a steering arm connected to a side of the first steering nozzle;

wherein the second steering nozzle has an indentation on one side thereof; and wherein when the second steering nozzle is rotated relative to the first steering nozzle about the second steering axis in one steering direction, part of the steering arm is received in the indentation.

12. The jet propulsion system of claim 7, wherein one of the first and second steering nozzles has a first boss formed about the second steering axis between upper portions of the first and second steering nozzles such that the first steering nozzle contacts the second steering nozzle via the first boss; and wherein one of the first and second steering nozzles has a second boss formed about the second steering axis between lower portions of the first and second steering nozzles such that the first steering nozzle contacts the second steering nozzle via the second boss.

13. A steering nozzle assembly for a marine jet propulsion system of a watercraft comprising:

a first steering nozzle having a first aperture in a first side thereof and a second aperture in a second side thereof opposite the first side, the first and second apertures being coaxial with a first steering axis, the first steering axis being generally perpendicular to a central longitudinal axis of the first steering nozzle;

a second steering nozzle rotationally mounted relative to the first steering nozzle about a second steering axis, the second steering axis being offset from the first steering axis and being generally perpendicular to a central longitudinal axis of the second steering nozzle; and a first linkage having a first end and a second end, the first end being adapted to be rotationally connected to a bracket mounted to one of a jet pump of the marine jet propulsion system, a venturi of the marine jet propulsion system, and a hull of the watercraft, the second end being rotationally connected to the second steering nozzle;

wherein the first steering axis and the central longitudinal axis of the first steering nozzle define a plane; and wherein when the central longitudinal axis of the second steering nozzle is disposed in the plane, the first end of the first linkage is disposed on a first side of the plane and the second end of the first linkage is disposed on a second side of the plane, the second side being opposite the first side.

14. The steering nozzle assembly of claim 13, wherein the first steering nozzle is rotationally mounted to the bracket about the first steering axis; and wherein the first end of the first linkage is rotationally connected to the bracket.

15. The steering nozzle assembly of claim 14, wherein when the central longitudinal axis of the second steering nozzle is disposed in the plane, the first end is disposed between the first and second steering axes.

16. The steering nozzle assembly of claim 13, wherein one of the first and second steering nozzles has a first boss formed about the second steering axis between first portions of the first and second steering nozzles such that the first steering nozzle contacts the second steering nozzle via the first boss; and wherein one of the first and second steering nozzles has a second boss formed about the second steering axis between second portions of the first and second steering nozzles such that the first steering nozzle contacts the second steering nozzle via the second boss, the second portions being opposite the first portions.

* * * * *